US010988867B2

(12) United States Patent
Bruynoghe et al.

(10) Patent No.: US 10,988,867 B2
(45) Date of Patent: Apr. 27, 2021

(54) SELVEDGE DEVICE

(71) Applicant: NV MICHEL VAN DE WIELE, Kortrijk/Marke (BE)

(72) Inventors: Koen Bruynoghe, De Pinte (BE); Geert Maes, Gullegem (BE)

(73) Assignee: NV MICHEL VAN DE WIELE

( * ) Notice: Subject to any disclaimer, the term of this patent is extended or adjusted under 35 U.S.C. 154(b) by 169 days.

(21) Appl. No.: 16/478,014

(22) PCT Filed: Jan. 9, 2018

(86) PCT No.: PCT/IB2018/050121
§ 371 (c)(1),
(2) Date: Jul. 15, 2019

(87) PCT Pub. No.: WO2018/130933
PCT Pub. Date: Jul. 19, 2018

(65) Prior Publication Data

US 2019/0368081 A1 Dec. 5, 2019

(30) Foreign Application Priority Data

Jan. 13, 2017 (BE) ..... 2017/5018

(51) Int. Cl.
*D03C 11/00* (2006.01)
*D03C 3/18* (2006.01)
*D03D 1/00* (2006.01)

(52) U.S. Cl.
CPC ..... *D03C 11/00* (2013.01); *D03C 3/18* (2013.01)

(58) Field of Classification Search
CPC ..... D03C 11/00; D03C 3/18; D03C 13/00; D03C 7/00; D03D 39/02; D03D 19/00; D03D 39/16; D03D 5/00
See application file for complete search history.

(56) References Cited

U.S. PATENT DOCUMENTS 1,524,398 A * 1/1925 Kenney ..... D03D 39/16 139/21
2,145,715 A * 1/1939 Dick ..... A47G 9/0238 139/383 R
2,152,592 A * 3/1939 Hardiman ..... D03D 39/16 139/21

(Continued)

FOREIGN PATENT DOCUMENTS

CN 203 625 580 U 6/2014
JP 1 731 640 A2 12/2006

OTHER PUBLICATIONS

International Search Report and Written Opinion dated Apr. 16, 2018.

*Primary Examiner* — Robert H Muromoto, Jr.
(74) *Attorney, Agent, or Firm* — Fresh IP PLC; Clifford D. Hyra; Aubrey Y. Chen

(57) ABSTRACT

A selvedge device (1), having at least two pairs of heddle holders (2) for holding heddles (3) on either side, a drive device for driving the two pairs of heddle holders (2) by reciprocating movements, in which the drive device has at least two drive bodies (4) and each pair of heddle holders (2) is attached to a drive body (4), and in which the heddle holders (2) of at least one pair of heddle holders (2) are attached to the corresponding drive body (4) so as to be height-adjustable with respect to this corresponding drive body (4).

16 Claims, 7 Drawing Sheets

(56) References Cited

U.S. PATENT DOCUMENTS

| | | | | | |
|---|---|---|---|---|---|
| 2,985,197 | A * | 5/1961 | Worth | D03D 39/02 | 139/8 |
| 2,986,174 | A * | 5/1961 | Worth | D06N 7/0028 | 139/401 |
| 2,986,175 | A * | 5/1961 | Worth | D03D 39/02 | 139/401 |
| 5,031,668 | A * | 7/1991 | Bell | D03C 13/00 | 139/76 |
| 5,257,649 | A * | 11/1993 | Froment | D03C 3/26 | 139/59 |
| 6,189,576 | B1 * | 2/2001 | Markward | D03C 11/00 | 139/54 |
| 6,772,796 | B2 * | 8/2004 | Debaes | D03J 1/22 | 139/296 |
| 7,287,553 | B2 * | 10/2007 | Wahhoud | D03C 7/06 | 139/101 |
| 7,493,920 | B2 * | 2/2009 | Vanderjeugt | D03C 1/16 | 139/55.1 |
| 2006/0169347 | A1 * | 8/2006 | Wahhoud | D03D 19/00 | 139/383 R |
| 2017/0247819 | A1 * | 8/2017 | Yamauchi | D03C 3/20 | |
| 2019/0368081 | A1 * | 12/2019 | Bruynoghe | D03C 3/18 | |
| 2020/0275744 | A1 * | 9/2020 | Cheynet | D03D 15/56 | |

* cited by examiner

SELVEDGE DEVICE

This application is a National Phase entry of International Application No. PCT/IB2018/050121 under § 371 and claims the benefit of Belgian patent application No. BE2017/5018, filed Jan. 13, 2017, which is hereby incorporated by reference in its entirety.

FIELD OF THE DISCLOSURE

The present disclosure relates to a selvedge device, comprising at least two pairs of heddle holders for holding heddles on either side by means of each pair of heddle holders, a drive device for driving the two pairs of heddle holders by reciprocating movements, in which the drive device comprises at least two drive bodies and each pair of heddle holders is attached to a said drive body.

More specifically, but not in a limiting way, the present disclosure relates to such a selvedge device for a double-face weaving machine.

In addition, the present disclosure relates to a weaving machine comprising such a selvedge device and, more specifically, a double-face weaving machine.

BACKGROUND

During each operating cycle of a weaving process, weft insertion systems can insert one or more wefts between warp yarns, which have been positioned according to predetermined patterns and/or weave structures, in order to thus produce one or more fabrics.

By means of such selvedge devices, so-called selvedges are formed on the edge of a fabric with a weave structure which may differ from the weave structure of the fabric itself. As a result thereof, the wefts are caught and retained and remain present in the resultant fabric in stretched form. Fabric edges which are necessary for after-treatments may be provided in the same way. In this case, it is often necessary to produce complicated weave structures in a limited area.

Said drive bodies of the selvedge device are moved according to reciprocating movements by the drive device in order to drive the heddle holders according to these movements. These reciprocating movements may be directed in opposite directions.

A pair of heddle holders may hereto be connected to each other as part of a weaving frame.

The heddles are provided with heddle eyelets in which selvedge yarns and warp yarns are inserted. By means of the reciprocating movements, a shed is formed between the selvedge yarns during successive operating cycles of a weaving machine. A weft yarn is arranged in the resultant shed in each case. In order to catch and retain a weft, the selvedge yarns have to cross after each weft. Preferably, these crossings are produced by shifting the heddle holder pairs per two in counterphase.

Even with two pairs of heddle holders, per weft insertion system, moving in counterphase, it is possible to form a so-called one-one weave structure, in which a crossing is produced after each inserted weft yarn. Each weft yarn is then caught, both on the left and on the right, by a selvedge yarn.

If, for example, so-called two-two weave structures have to be possible, an additional pair of heddle holders is required for each weft insertion system to ensure that each weft yarn is caught. The four pairs of heddle holders preferably move two by two in counterphase, but other movements are also possible, as long as a crossing is produced after each weft.

Such one-one weave structures require 2 pairs of heddle holders for plain-weaving machines, 4 pairs of heddle holders for double-face weaving machines with 2 weft insertion systems and 6 pairs of heddle holders for double-face weaving machines with 3 weft insertion systems.

Such two-two weave structures require 4 pairs of heddle holders for plain-weaving machines, 8 pairs of heddle holders for double-face weaving machines with 2 weft insertion systems and 12 pairs of heddle holders for double-face weaving machines with 3 weft insertion systems.

Wefts may be inserted by means of air or water or by means of a projectile. Preferably, a weft insertion system consists of a pair of cooperating rapiers, which take the weft from one side of the weaving machine to the other side of the weaving machine and pass the weft to one another midway.

With such selvedge devices, it is always important for the selvedge heddles with the selvedge yarns inserted in their heddle eyelets to be moved up and down as quickly as possible in order to be able to lock the weft yarns in as quickly as possible, without the rapiers touching the selvedge yarns or the heddle eyelets. The selvedge shed formed by the selvedge yarns preferably adjoins the movement path of the rapier in the fabric to be formed as closely as possible. The rest position of a heddle eyelet is therefore preferably placed in the centre of the selvedge shed to be formed. The more accurately these heddle eyelets are placed in the desired position, the smaller the reciprocating movements can be and the quicker the weft yarns can be locked in.

In a heddle, the heddle eyelet takes up most space. Sometimes, the rest positions of the heddle eyelets of the selvedge heddles which perform identical movements are placed at different positions with respect to each other. In this way, the selvedge heddles can move through the shed slightly more easily, because they have more options when the selvedge yarns cross.

However, when modifying a weaving machine for weaving another fabric, the position of one or more heddle eyelets may be moved, so that a larger reciprocating movement is required to ensure that the rapiers do not touch the selvedge yarns. As a result thereof, the weft yarns are locked in less rapidly.

Also when replacing heddles, the heddle eyelets of newly installed heddles may deviate from the desired position.

In such cases, adapting the position of one or more heddle eyelets may be effected in some weaving machines by shortening and/or lengthening corresponding heddle cords on one or both sides. However, in practice, this is a relatively difficult task. In addition, the reproducibility of such an adjustment is relatively limited. Wear further renders this adjustment option more difficult.

Often, it is also possible to move the entire selvedge device in the weaving machine. However, this means that all heddle eyelets are moved simultaneously, as a result of which deviations of one heddle eyelet cannot be compensated for.

SUMMARY

It is an object of embodiments of the present invention to solve the abovementioned problems.

This object may be achieved by providing a selvedge device, comprising at least two pairs of heddle holders for holding heddles on either side by means of each pair of heddle holders, a drive device for driving the two pairs of heddle holders by reciprocating movements, in which the drive device comprises at least two drive bodies and each pair of heddle holders is attached to a said drive body, and in which the heddle holders of at least one pair of heddle holders are attached to the corresponding drive body so as to be height-adjustable with respect to this corresponding drive body.

By providing the heddle holders of a pair of heddle holders so as to be individually height-adjustable with respect to a corresponding drive body, it is possible to adjust the position of heddle eyelets much more quickly, with more adjustment options being provided than when the entire selvedge device is moved.

The adjustability of such components with respect to each other can be achieved in a manner which is simpler than shortening or lengthening heddle cords and is also less susceptible to wear.

Preferably, in this case, each pair of heddle holders is attached to the corresponding drive body so as to be height-adjustable.

Preferably, the drive device of a selvedge device according to embodiments of the present invention comprises at least one motor, a drive shaft driven by the motor and, for each said drive body, a drive arm attached to the drive shaft and a drive rod whose one end is pivotably connected to the drive arm and whose other end is pivotably connected to the corresponding drive body.

Such drive devices are known, for example from EP 1 731 640 B1, BE 1 017 768 A3 and BE 1 009 375 A6.

By means of such drive devices, the heddles can now only be moved vertically together with the entire selvedge device. With such drive devices, it would be possible to adapt these drive devices with limited resources in such a way that heddle holders are provided on the drive body so as to be height-adjustable in order to convert them to devices according to embodiments of the present invention.

If such drive devices are provided with several motors in order to realize several desired movements, then they have to be provided with several corresponding drive shafts, drive arms and drive rods as well.

A particular embodiment of a selvedge device according to the present invention comprises several pairs of heddle holders per weft insertion system in order to form a shed. Such a selvedge device preferably comprises pairs of heddle holders which are drivable with the same reciprocating movement and arranged adjacent to each other.

These pairs of heddle holders are preferably driven by the same motor. This embodiment is particularly compact.

A very particular embodiment of such a selvedge device according to the present invention with several pairs of heddle holders per weft insertion system is provided for forming a selvedge shed for several weft insertion systems of a double-face weaving machine.

By arranging pairs of heddle holders performing the same reciprocating movement adjacent to each other, the friction between heddle holders moving with respect to each other is limited. Due to the fact that these juxtaposed pairs of heddle holders move together, not all pairs of heddle holders move with respect to each other, but only heddle holders arranged in a group move with respect to each other. Thus, there are fewer friction surfaces in which heddle holders move up and down with respect to each other.

Also in selvedge devices for double-face weaving machines without said vertical adjustability of the heddle holders with respect to the corresponding drive body, it is advantageous to arrange the heddle holders with respect to each other in this way.

In such selvedge devices as well, the number of friction surfaces is reduced, so that such an arrangement results in a compact and reliable selvedge device for double-face weaving machines.

In all said selvedge devices in which pairs of heddle holders which are drivable with the same reciprocating movement are arranged adjacent to each other, the adjacent heddle holders of these pairs are preferably also fixed with respect to each other. In this way, small relative movements of these heddle holders with respect to each other are also limited, as well as tilting of these heddle holders.

Heddle holders which are fixed with respect to each other in this way, are preferably detachably coupled to each other, so that they can also be provided so as to be individually height-adjustable.

Coupling such heddle holders to each other so as to be detachable may, for example, be achieved by means of a fixing bolt.

In a preferred embodiment, said pairs of heddle holders which are drivable with the same reciprocating movement and which are arranged adjacent to each other, are attached to the same drive body. In this way, it is sufficient to provide two motors, in the case of double-face weaving machines, in order to be able to also produce two-two weave structures.

Each pair of heddle holders of a selvedge device according to some embodiments of the present invention is preferably coupled to each other by means of a coupling element.

Together with this coupling element, the heddle holders of this pair then form a weaving frame in which heddles can be held.

In order to be able to hold the heddles between the heddle holders, this coupling element is preferably arranged on one side of the heddle holders, so that the heddle holders and this coupling element form a substantially C-shaped weaving frame. Optionally, this weaving frame may be closed further by providing a coupling element on the other side of the heddle holders. However, the weaving frames may be made more lightweight, which makes them movable more quickly, by only providing a coupling element on one side. This coupling element is then preferably arranged on the side of the drive element, in which the heddle holders are preferably attached to the drive body so as to be height-adjustable by means of this coupling element.

Providing the heddle holders so as to be height-adjustable with respect to the drive body may be achieved in a considerable number of ways.

In a specific embodiment, the height-adjustability is achieved by arranging the coupling element so as to be freely rotatable with respect to said corresponding heddle holders, in which these heddle holders are vertically locked with respect to this coupling element. In this case, the coupling element may, optionally after vertical adjustment, be secured with respect to the respective heddle holders, as long as it can freely rotate with respect to the respective heddle holders during the vertical adjustment. The corresponding drive body may then be attached to this coupling element so as to be height-adjustable, for example by means of a screw thread. During rotation of this coupling element, the height of the heddle holders with respect to this coupling element is locked, while this coupling element rotates freely with respect to the heddle holders. Thus, the height of the heddle holders with respect to the coupling element remains unchanged. During this rotation, the drive body is moved vertically with respect to the coupling element by means of the screw thread. In this way, the height of the heddle holders with respect to the drive body is adjusted. Such a vertical adjustment by means of a screw thread is readily reproducible.

Conversely, it is for example also possible to arrange the coupling element so as to be freely rotatable with respect to the corresponding drive body, in which case this drive body is vertically locked with respect to the coupling element. In this case, the heddle holders may be attached to the coupling element so as to be height-adjustable by means of a screw thread. In this case as well, the coupling element may optionally be fixed with respect to the drive body after the height has been adjusted, so that rotation of the coupling element with respect to the corresponding drive body is only possible when adjusting the height.

Locking the heddle holders or the drive element vertically with respect to the coupling element may be achieved in several ways.

The coupling element may, for example, be of a rod-shaped design and may, for each heddle holder, be provided with at least one local diameter reduction in which the corresponding heddle holder is arranged in a vertically locked manner, so that the coupling element is freely rotatable with respect to the heddle holder. Conversely, a rod-shaped coupling element may be provided with at least one local diameter reduction in which the drive body is arranged in a vertically locked manner, so that the coupling element is freely rotatable with respect to the drive body.

Instead of a vertical lock by means of such a local diameter reduction, it is for example also possible to provide a local diameter increase or a local protrusion in order to achieve the vertical locking.

Providing the drive element or the heddle holders so as to be height-adjustable with respect to such a coupling element by means of a screw thread may also be achieved in several ways.

The coupling element may be provided, for example, with at least one local external screw thread, in which a corresponding internal screw thread of the drive body engages, or may, conversely, be provided with at least one local external screw thread in two locations, in which a corresponding internal screw thread of a corresponding heddle holder engages.

Heddle holders which are releasably coupled—as described above—are preferably fixed with respect to each other after the height has been adjusted in the manner described above. In order to adjust the height again, the former have to be uncoupled again.

In a particular embodiment, a selvedge device according to the present invention may also comprise drive means for automatically adjusting the height of the height-adjustable heddle holders.

In a preferred embodiment, each heddle holder comprises a bar-shaped heddle carrier on which the corresponding heddles are fittable so as to be laterally displaceable. In this case, this bar-shaped heddle carrier may in itself form the heddle holder or may form part of this heddle holder.

Such a fastening of the heddles to a bar-shaped heddle carrier allows a small lateral displacement of the heddles. If, for example, there is a knot in the yarn, the heddles are able to laterally diverge slightly in order to allow for this.

In a further specific embodiment, each heddle holder, on its side facing away from the corresponding drive body, is provided with a nose, having a length which is such that adjacent heddle holders which perform a deviating reciprocating movement remain adjacent to each other for their entire reciprocating movement.

These noses ensure that adjacent heddle holders which perform a deviating reciprocating movement can never end up above or below one another as a result of deflections, but always remain adjacent to each other, viewed in warp direction.

In a particularly preferred embodiment, the heddle holders are in this case coupled to each other on the side of the drive body by means of a coupling element and provided with such a nose on their other side, so that a lightweight weaving frame is produced in which inconvenient deviations of the weaving frames are limited.

The drive bodies of a selvedge device according to embodiments the present invention are preferably provided with guide elements, in which case the selvedge device comprises vertically extending guides for guiding these guide elements during the reciprocating movements.

The object may also be achieved by providing a weaving machine comprising a selvedge device according to an embodiment of the present invention.

If this weaving machine is, more specifically, a jacquard weaving machine, comprising a jacquard which is arranged above a fabric to be formed, then the selvedge device is preferably arranged between the jacquard and the fabric to be formed.

Preferably, this selvedge device is then arranged completely under the jacquard.

In this way, such a selvedge device according to an embodiment of the present invention is placed in a lower position in such a jacquard weaving machine than existing selvedge devices, thus rendering the Jacquard more readily accessible.

In a particular embodiment, a weaving machine according to the present invention is a double-face weaving machine.

BRIEF DESCRIPTION OF THE DRAWINGS

The present invention will now be explained in more detail by means of the following detailed description of an embodiment of a selvedge device according to the present invention. The sole aim of this description is to give illustrative examples and to indicate further advantages and features of the present invention, and can therefore by no means be interpreted as a limitation of the area of application of the invention or of the patent rights defined in the claims.

In this detailed description, reference numerals are used to refer to the attached drawings, in which.

DETAILED DESCRIPTION

Figure 7:
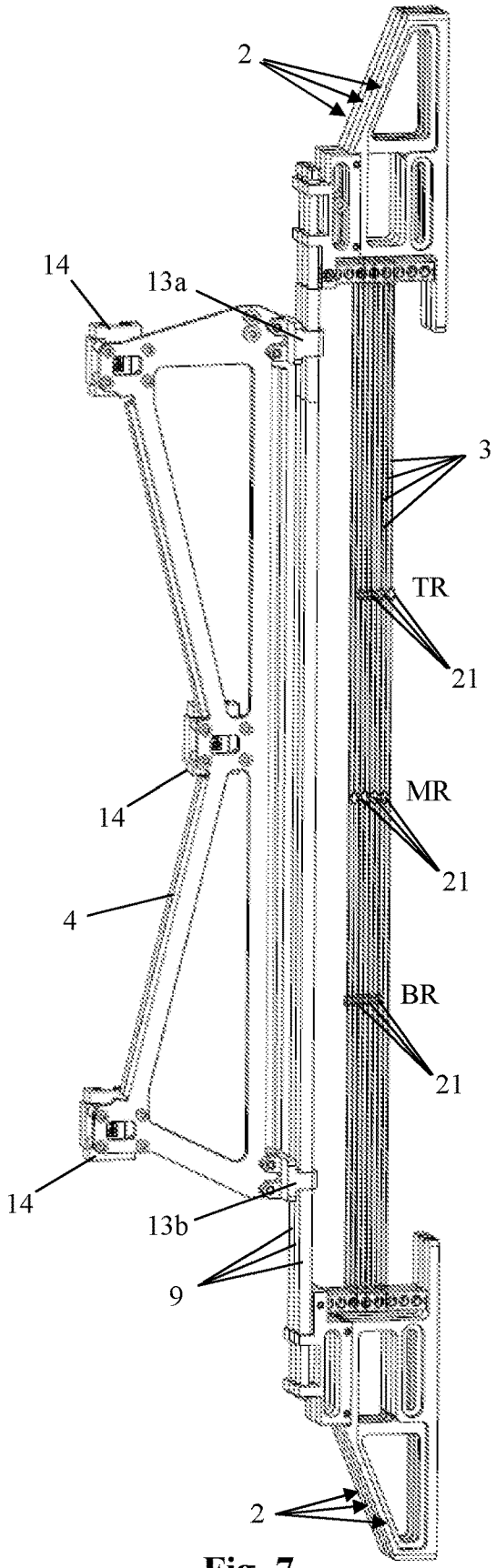
FIG. 7 shows a drive body with coupling elements and heddle holders of the selvedge device from FIG. 1 attached thereto separately in perspective, with heddles attached to the heddle holders.
Figure 11:
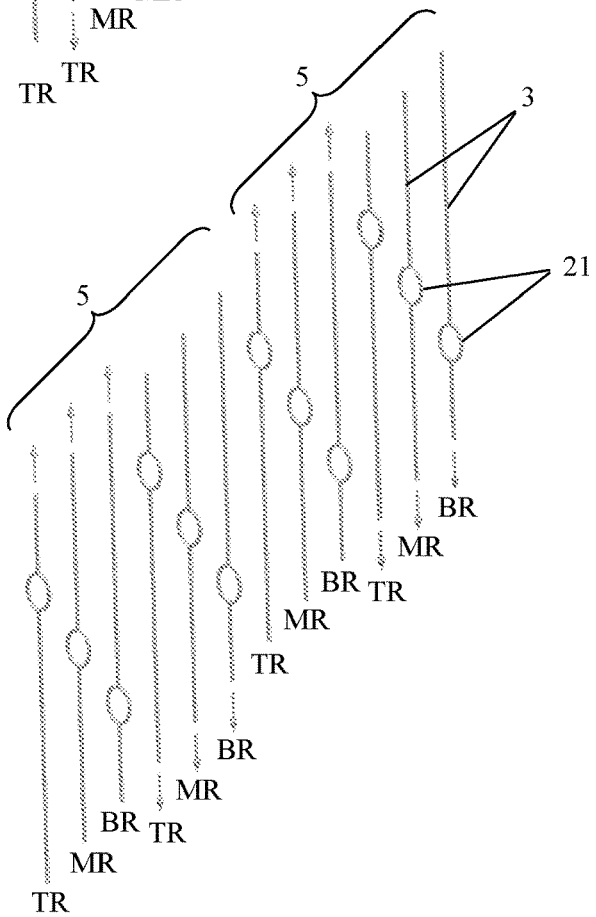
FIG. 11 diagrammatically shows how the heddles are arranged and actuated with respect to each other in the selvedge device illustrated in FIG. 1, with only one heddle per executed movement being shown for each rapier.

The selvedge devices (1) illustrated in the figures are selvedge devices (1) for a double-face weaving machine with three rapiers, by means of which different kinds of weave structures, such as, inter alia, two-two weave structures, can be produced. As can be seen in FIGS. 1 to 5, this selvedge device (1) comprises twelve pairs of heddle holders (2) to this end. Each pair of heddle holders (2) comprises a bottom heddle holder (2) and a top heddle holder (2), between which heddles (3) can be held, as can be seen in FIG. 7. For each rapier of the double-face weaving machine, two times two pairs of such heddle holders (2) are provided, which can move per two pairs in counterphase with respect to each other. Three pairs of heddle holders (2) which can form, together with corresponding heddle holders (2) which move in counterphase, a shed for the three rapiers are in each case arranged next to each other. FIG. 7 and FIG. 11 show that a pair of such three pairs of heddle holders (2) arranged together holds heddles (3) with heddle eyelets (21) which are arranged in a higher position, holds a pair of heddles (3) with heddle eyelets (21) which are arranged centrally and holds a pair of heddles (3) with heddle eyelets (21) which are arranged in a lower position. The heddles (3) with heddle eyelets (21) which are arranged in a higher position, are provided to form a shed for the top rapier (TR), together with corresponding heddles (3) which are moved in counterphase. The heddles (3) with heddle eyelets (21) which are arranged centrally, are provided to form a shed for the middle rapier (MR), together with corresponding heddles (3) which are moved in counterphase. The heddles (3) with heddle eyelets (21) which are arranged in a lower position, are provided to form a shed for the bottom rapier (BR), together with corresponding heddles (3) which are moved in counterphase.

FIGS. 1 to 5 show that 6 pairs of heddle holders (2) which are arranged on the left-hand side are at the same height, so that the heddles (3) held therein do not form a shed at that position. The 6 pairs of heddle holders (2) which are arranged on the right-hand side are positioned in groups of three in counterphase, so that the heddles (3) held therein together form a shed for corresponding rapiers.

In FIG. 11, arrows indicate how the heddles (3) are moved in counterphase in groups of three, with the left-hand six heddles (3) being driven by a first motor (5) and the right-hand six heddles (3) being driven by a second motor (5).

Figure 10:
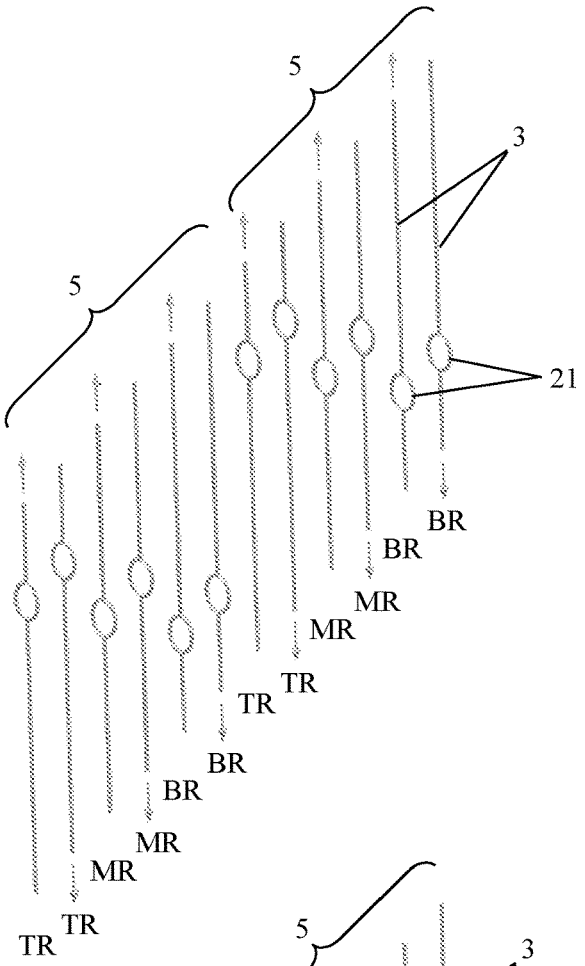
FIG. 10 diagrammatically shows how the heddles are arranged and actuated with respect to each other in existing selvedge devices for a double-face weaving machine with three rapiers, with only one heddle per executed movement being shown for each rapier.

FIGS. 10 and 11 show how this arrangement of the heddle holders (2) of the illustrated selvedge device (1) (FIG. 11) with respect to each other results in an advantageous deviating arrangement of the heddles (3) compared to existing selvedge devices (1) for double-face weaving machines with three rapiers (FIG. 10). For the sake of clarity, only one heddle (3) per rapier is illustrated in both figures for each executed movement. The heddle eyelets (21) associated with the top rapier (TR), with the middle rapier (MR) and with the bottom rapier (BR) are situated more or less on the same straight line, respectively.

With such existing selvedge devices (1), the heddles (3) which form for each motor (5) the shed for the top rapier (TR) are placed next to each other, the heddles (3) which form for each motor (5) the shed for the middle rapier (MR) are placed next to each other and the heddles (3) which form for each motor (5) the shed for the bottom rapier (BR) are placed next to each other. As a result thereof, more heddles (3) are each time moved with respect to each other than is the case with the arrangement of the illustrated selvedge device (1). This new arrangement therefore causes significantly less friction between components which are moved with respect to each other, thus greatly reducing wear.

In addition, with such existing selvedge devices (1), harness cords are passed through openings in a comberboard in order to achieve a desired positioning of the heddles (3).

By using the heddle holders (2) and arranging them in a group in the manner described above, this comberboard is no longer necessary in order to bring the heddles (3) to the desired position. Such a comberboard is highly susceptible to wear. If the heddles (3) are required to make a small lateral movement, the harness cord rubs over the edge of its opening in the comberboard, resulting in wear and, in the longer term, breakage (either of the comberboard, which is excessively worn, or of the harness cord).

For a double-face weaving machine, it would suffice to provide 8 such pairs of heddle holders (2) for two-two weave structures. For a flat weaving machine, it would suffice to provide 4 such pairs of heddle holders (2).

In order to obtain weave structures, the illustrated selvedge devices comprise a drive device for moving the pairs of heddle holders (2) up and down, this per two in counterphase with respect to each other, in which each time the same movement is performed for the three rapiers for every 3 pairs of heddle holders (2).

Figure 1:
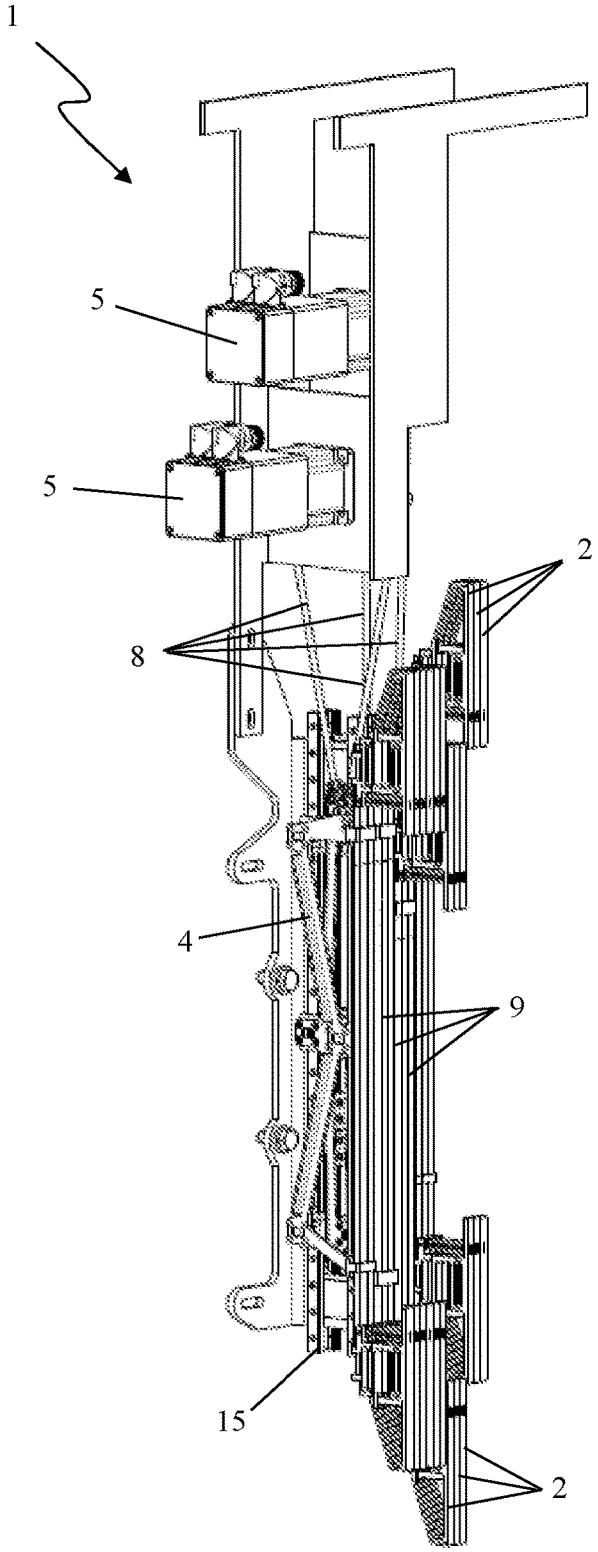
FIG. 1 shows a selvedge device according to the present invention in perspective.
Figure 2:
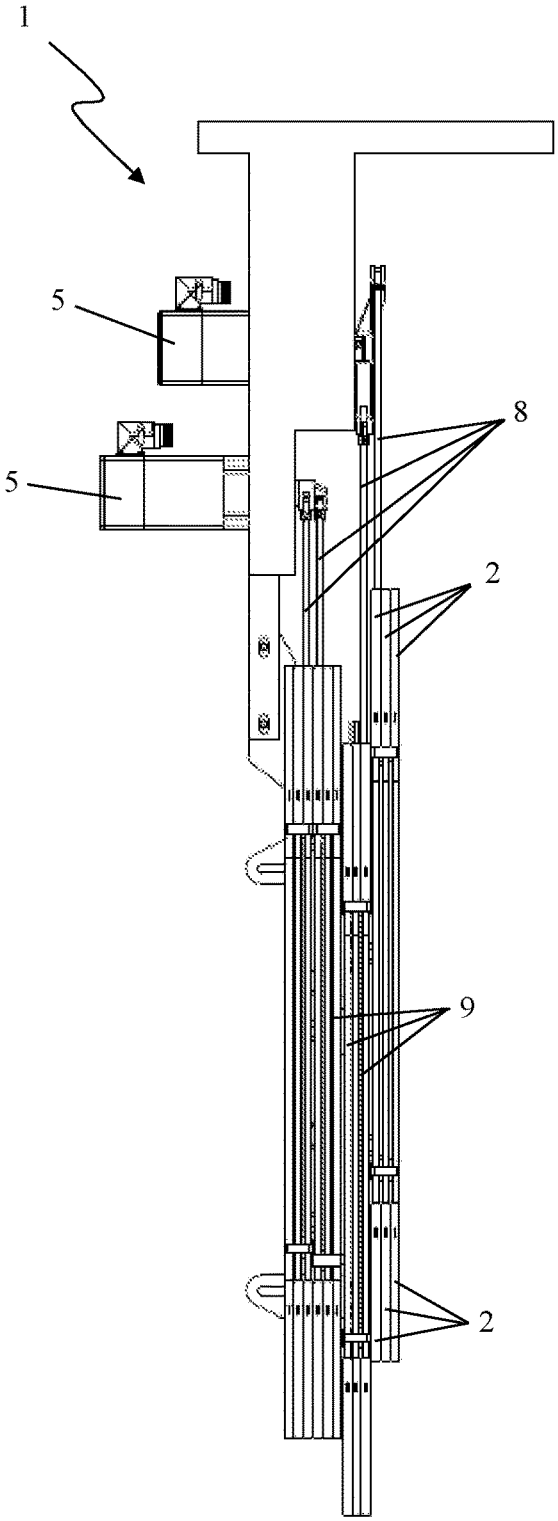
FIG. 2 shows the selvedge device from FIG. 1 in a right-hand side view.
Figure 3:
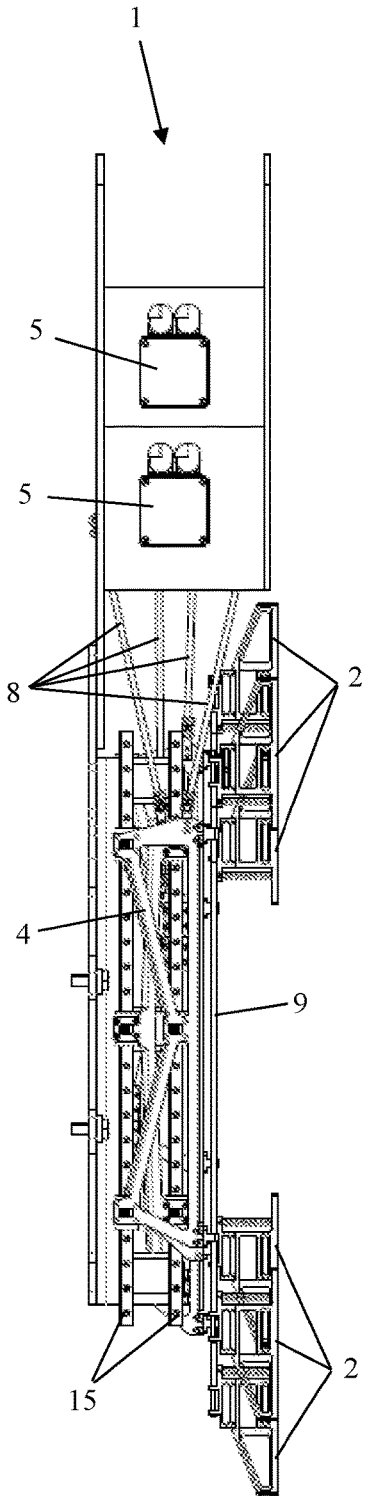
FIG. 3 shows the selvedge device from FIG. 1 in a front view.
Figure 4:
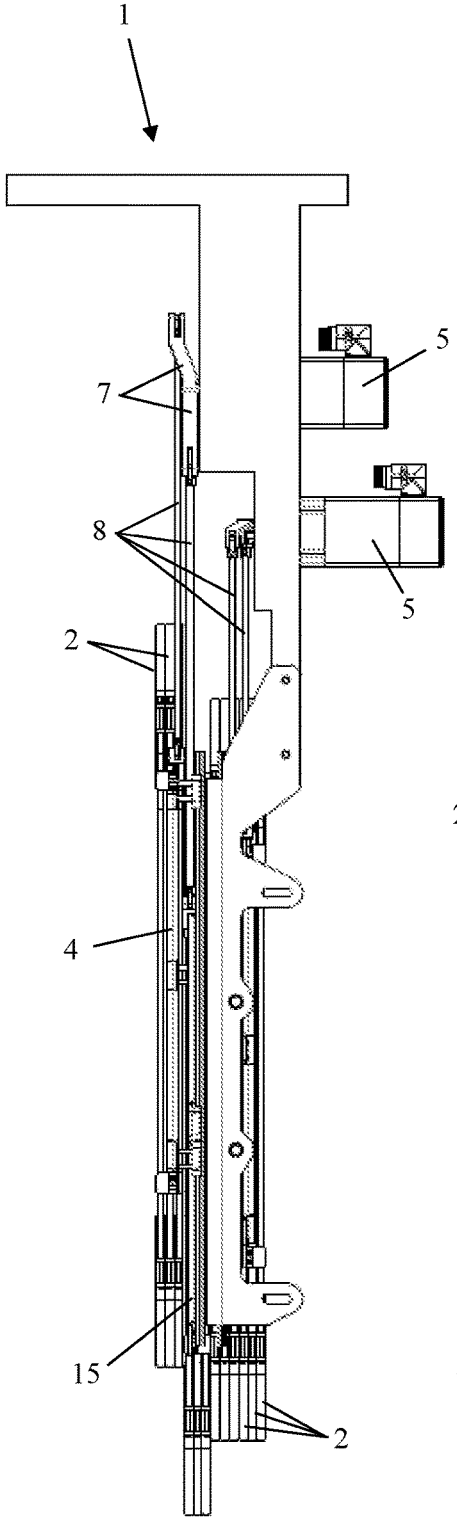
FIG. 4 shows the selvedge device from FIG. 1 in a left-hand side view.
Figure 5:
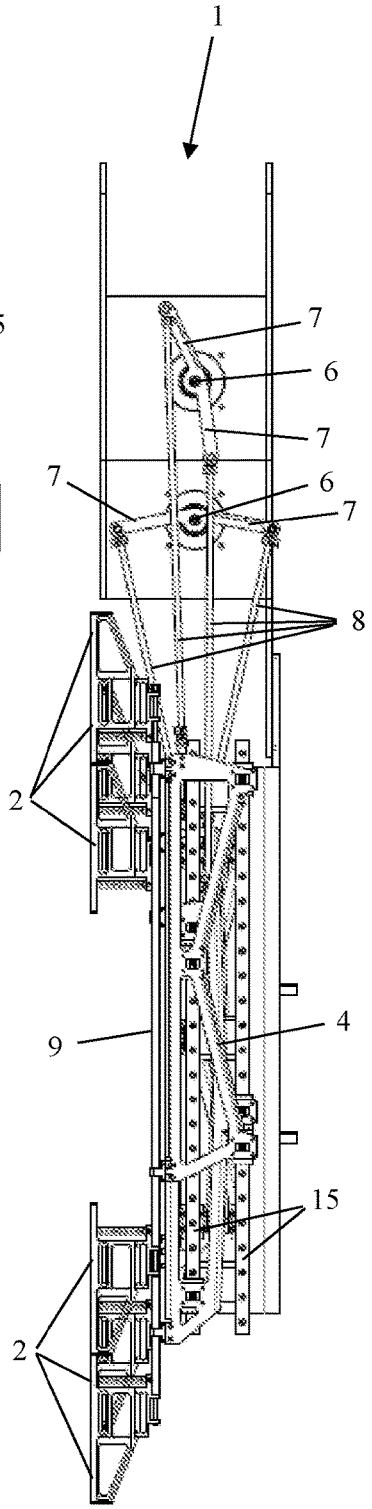
FIG. 5 shows the selvedge device from FIG. 1 in a rear view.
Figure 6:
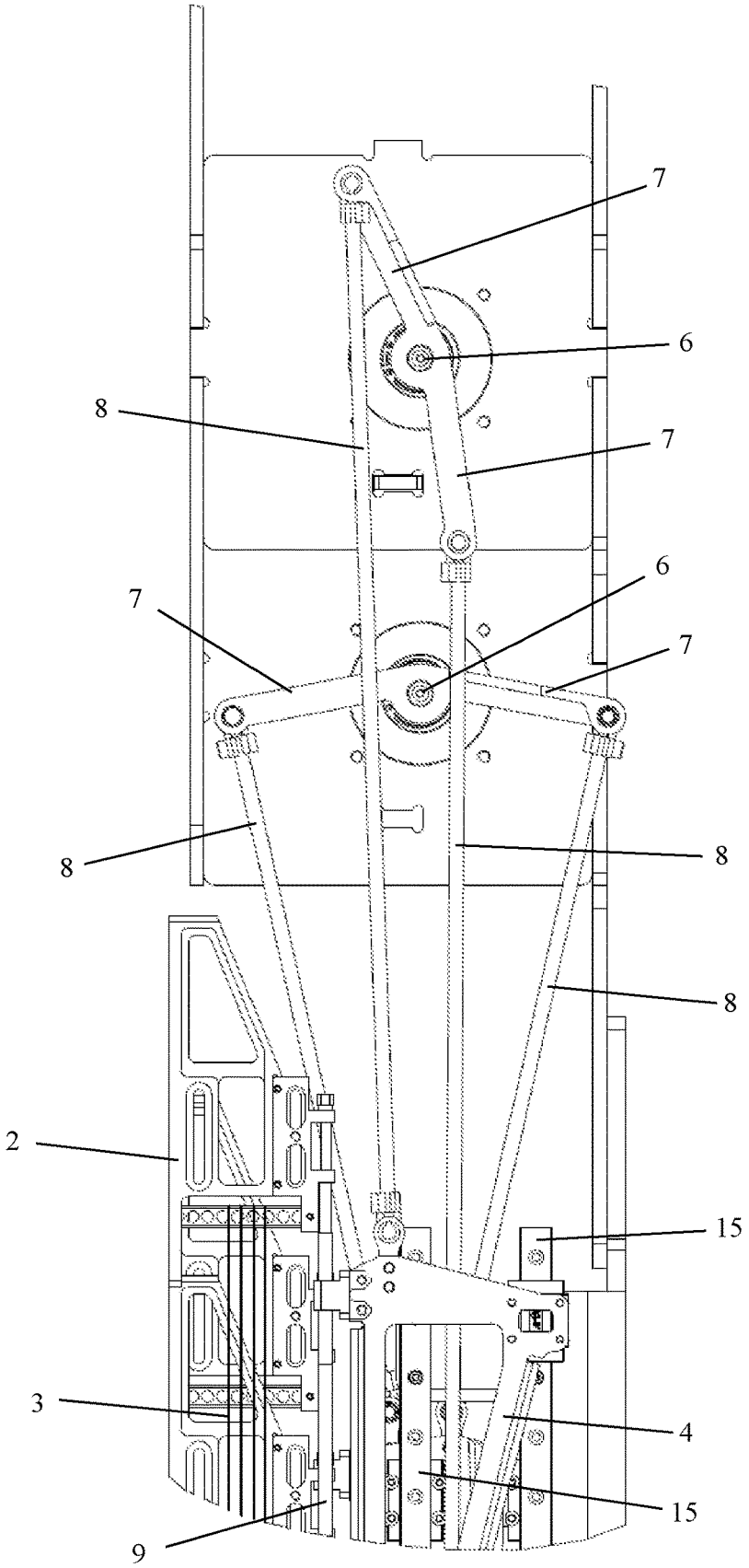
FIG. 6 shows the rear view from FIG. 5 in more detail at the top side of this selvedge device.

To this end, this drive device comprises two motors (5), each of which drives a drive shaft (6). These motors (5) are preferably cooled servomotors. This cooling may be effected by convection or by means of an airflow created by a ventilator. The motors may also be water-cooled. A couple of drive arms (7) are attached to each drive shaft (6) (see FIGS. 5 and 6). The drive arms (7) on each drive shaft (6) form an angle with respect to each other and are made together in one piece. However, they could also be separate drive arms (7). An end of a drive rod (8) is pivotably attached to the free end of each drive arm (7). A drive body (4) is attached to the other end of each drive rod (8). Three pairs of heddle holders (2) are attached to each drive body (4). By driving the drive shaft (6) by means of the motors (5), the drive bodies (4) are moved up and down and thus also the heddle holders (2) attached to these drive bodies (4). The drive bodies (4) which are attached to the one drive arm of a pair of drive arms (7) via a drive rod (8), perform a movement in counterphase with respect to the drive bodies (4) which are attached to the other drive arm of the same pair of drive arms (7) via a drive rod (8).

Figure 12:
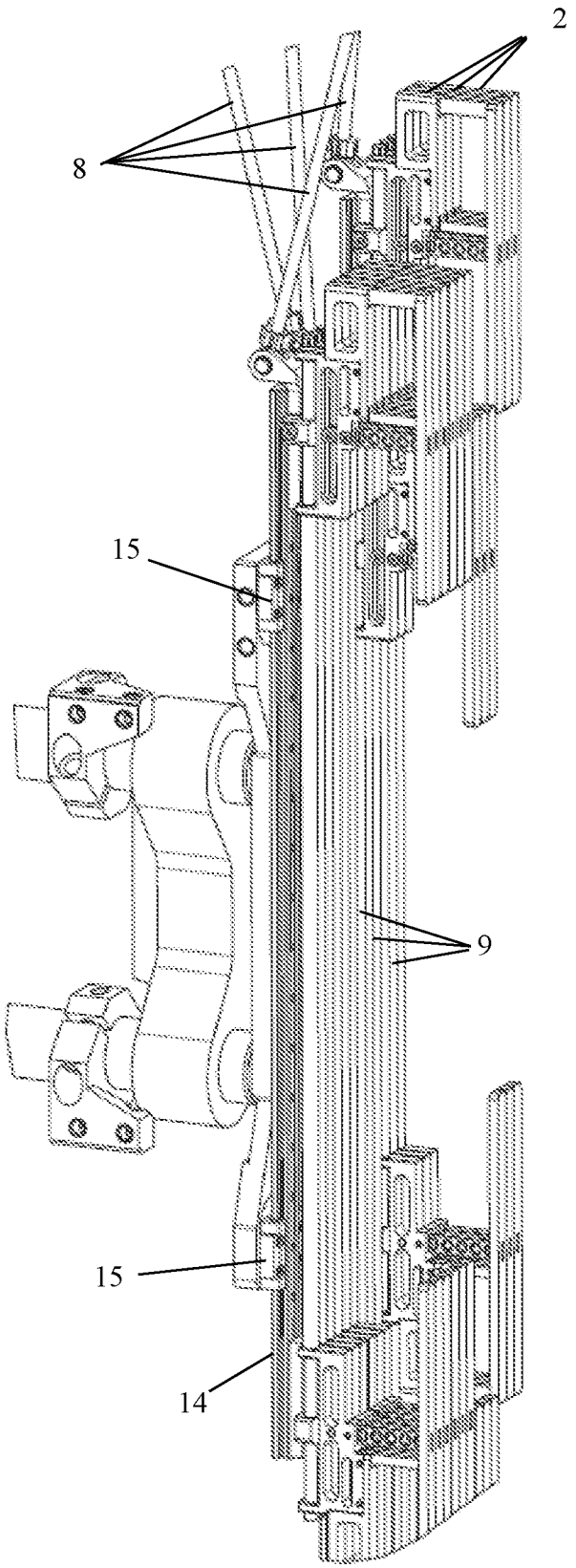
FIG. 12 shows a part of an alternative selvedge device at the drive bodies in perspective.
Figure 13:
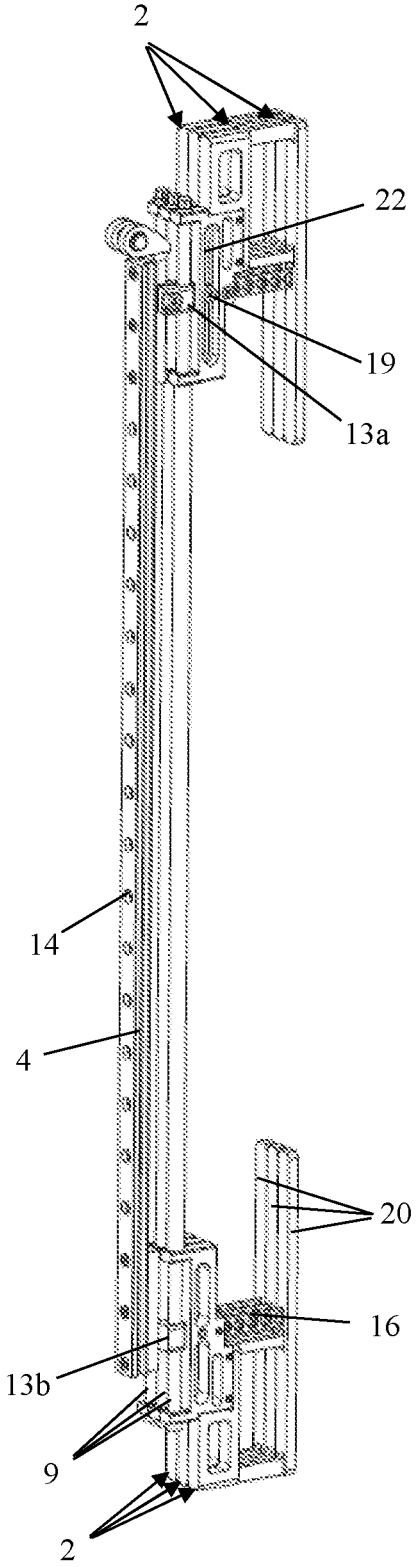
FIG. 13 shows an alternative drive body from the selvedge device from FIG. 12 with coupling elements and heddle holders attached thereto separately in perspective.

The movement of the drive bodies (4) is guided, due to the fact that the drive bodies (4) are provided with guide elements (14) which are arranged in a guiding manner with respect to vertically extending guides (15). In the first illustrated embodiment (see FIGS. 3-7), the guide elements (14) engage around elongate guides (15). In the second illustrated embodiment, the guides (14) engage in the guides (15) (see FIGS. 12-13).

In these selvedge devices (1), the heddle holders (2) are thus moved up and down in three pairs at a time, as a result of which only two motors (5) are required to execute the required movements. However, it would also be possible to provide a separate motor for every two pairs of heddle holders (2) moving in counterphase or for every pair of heddle holders (2). In this case, corresponding drive shafts, drive rods and drive bodies also have to be provided for every motor. Analogously, at least 2 motors and associated drive shafts, drive rods and drive bodies are required for double-face weaving machines with 2 rapiers in order to achieve two-two weave structures.

In order to be able to adjust the position of the heddle eyelets (21) accurately, the pairs of heddle holders (2) in the illustrated selvedge devices (1) are connected to each other by means of a coupling rod (9) which is attached to the corresponding drive body (4) in a height-adjustable manner, so that these heddle holders (2) are also height-adjustable with respect to this drive body (4).

Figure 8:
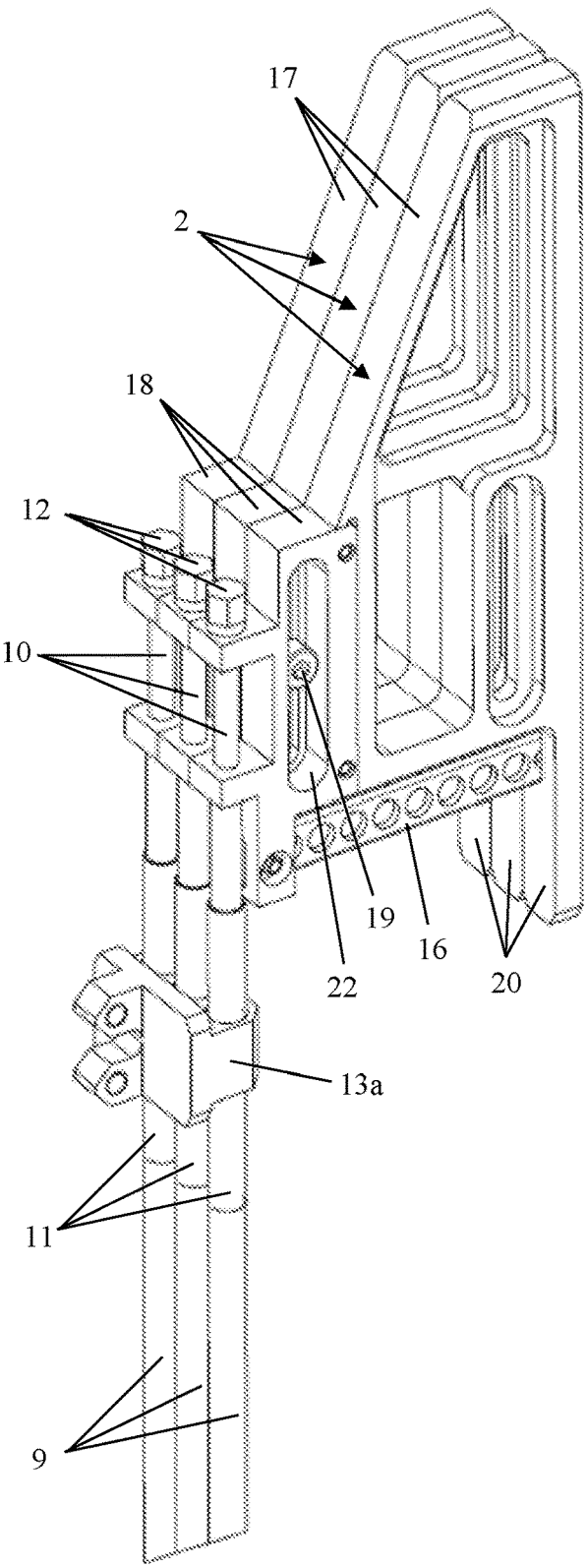
FIG. 8 shows a part of the coupling elements and the upper heddle holders from FIG. 7 in more detail in perspective.

As shown in FIG. 8, each coupling rod (9) has a portion with a reduced diameter (diameter reduction) (10) at its ends around which a fastening element (18) of the heddle holder (2) is arranged. The coupling rod is freely rotatable with respect to the heddle holder (2). Due to the diameter reduction (10), this fastening element (18) and consequently also the heddle holder (2) are vertically locked with respect to the coupling rod (9). The coupling rod (9) is attached to the drive body (4) by means of the fastening elements (13*a*) and (13*b*). At the top illustrated fastening element (13*a*) of the drive body (4), the coupling rod (9) is provided with an external screw thread (11). The illustrated top fastening element (13*a*) of the drive body (4) is provided with a corresponding internal screw thread. The coupling rod (9) is arranged so as to be freely rotatable in the bottom illustrated fastening element (13*b*). The coupling rods (9) are provided with an engagement element (12) at the top in order for a hand tool to engage therewith. Due to the corresponding screw threads (11), the fastening element (13*a*) of the corresponding drive body (4) is moved up and down in a corresponding manner with respect to a coupling rod (9) by rotating this coupling rod (9). Drive means may also be provided instead of the engagement element (12) or in addition to this engagement element (12), by means of which this coupling rod (9) can be rotated automatically.

When the various heddle holders (2) have been adjusted to a desired height with respect to the corresponding drive body (4) by means of their coupling rod (9), these may be fixed in groups of three with respect to each other by means of a fixing bolt (19), as is illustrated in FIG. 8. By fixing these with respect to each other, undesired deflections of the heddle holders (2) are limited. To this end, the fastening element (18) of each heddle holder (2) is provided with an elongate slot (22) which extends in the vertical direction. If the adjusted height of the three adjacent heddle holders (2) deviates with respect to each other, this fixing bolt (19) may be arranged at a corresponding deviating position in this slot (22) in the various heddle holders (2). If the position of the heddle holders (2) has to be modified, this fixing bolt (19) has to be unscrewed first before the corresponding coupling rod(s) (9) can be rotated and this fixing bolt (19) then has to be re-tightened.

An additional locking element may be provided at the location of the fastening elements (13*a*) and (13*b*) in order to lock the adjusted height.

The illustrated heddle holders (2) are furthermore, in addition to the fastening elements (18) already mentioned above, provided with a holder frame (17) and a heddle carrier (16).

The holder frame (17) helps to provide the required strength for the heddle holder (2). On the side of the heddle holder (2) facing away from the drive body (4), this holder frame (17) is provided with a nose (20) having a length which is such that adjacent heddle holders (2), which execute a deviating reciprocating movement, remain arranged adjacent to each other during their entire reciprocating movement. It can clearly be seen in FIG. 2, for example, that, in its illustrated highest position, the top heddle holder (2), which is third from the right, is still arranged next to the top heddle holder (2), which is fourth from the right and in its lowest position, due to this nose (20).

The heddle carrier (16) is bar-shaped and the corresponding heddles (3) are laterally displaceably attached to this heddle carrier (16) with a loop. The holes in the illustrated heddle carrier (16) are only provided in order to save weight.

Figure 9:
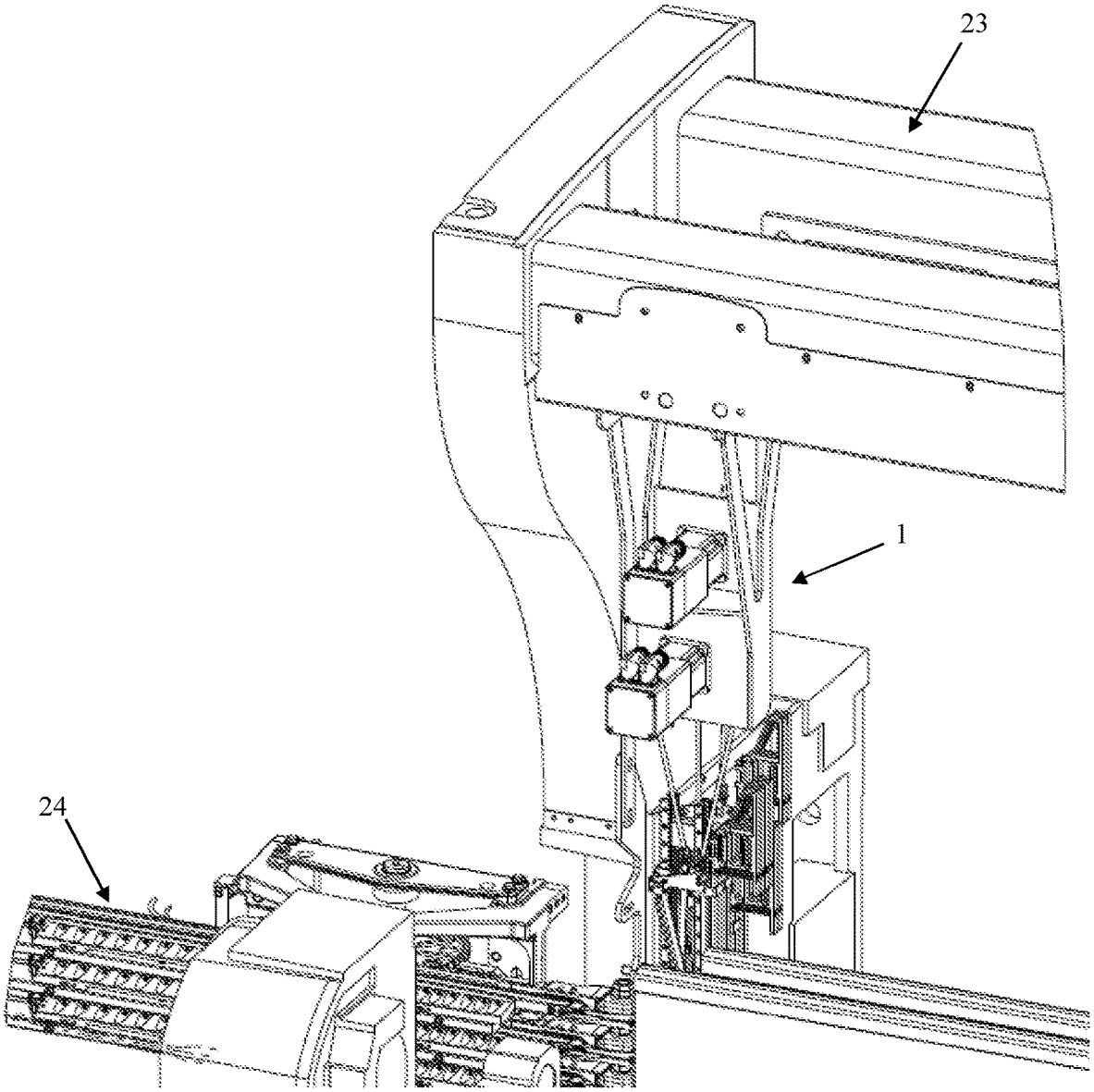
FIG. 9 shows a part of a double-face weaving machine comprising a selvedge device according to the present invention in perspective.

FIG. 9 shows how the first illustrated selvedge device (1) according to the present invention may be incorporated in a double-face weaving machine with three rapiers. Here, the selvedge device (1) is arranged between the superstructure (23) on which the jacquard is positioned and the position where the weave structures are formed, in the area of the illustrated rapier rods (24), next to the harness of the jacquard and in the space formed between the rear position of the weaving reed and the weaving frames.

The invention claimed is:

1. A selvedge device, comprising at least two pairs of heddle holders for holding heddles on either side by means of each pair of heddle holders, a drive device for driving the two pairs of heddle holders by reciprocating movements, in which the drive device comprises at least two drive bodies and each pair of heddle holders is attached to a said drive body, wherein the heddle holders of at least one pair of heddle holders are attached to the corresponding drive body so as to be height-adjustable with respect to this corresponding drive body; wherein each heddle holder, on its side facing away from the corresponding drive body, is provided with a nose having a length which is such that adjacent heddle holders which perform a deviating reciprocating movement remain adjacent to each other for their entire reciprocating movement.

2. The selvedge device according to claim 1, characterized in that the drive device comprises at least one motor, a drive shaft driven by the motor and, for each said drive body, a drive arm attached to the drive shaft and a drive rod whose one end is pivotably connected to the drive arm and whose other end is pivotably connected to the corresponding drive body.

3. The selvedge device according to claim 1, characterized in that the selvedge device is provided for forming a shed for each weft insertion system by means of several pairs of heddle holders, in which pairs of heddle holders are drivable with the same reciprocating movement to this end and are arranged adjacent to each other.

4. The selvedge device according to claim 3, characterized in that the selvedge device is provided for forming a shed for several weft insertion systems of a double-face weaving machine.

5. The selvedge device according to claim 3, characterized in that the adjacent heddle holders of the pairs of heddle holders which are drivable with the same reciprocating movement and which are arranged adjacent to each other, are fixed with respect to each other.

6. The selvedge device according to claim 5, characterized in that the heddle holders which are fixed with respect to each other are detachably coupled to this end.

7. The selvedge device according to claim 3, characterized in that the pairs of heddle holders which are drivable with the same reciprocating movement and which are arranged adjacent to each other, are attached to the same drive body.

8. The selvedge device according to claim 1, characterized in that each pair of heddle holders is coupled to each other by means of a coupling element.

9. The selvedge device according to claim 8, characterized in that either the coupling element is attached to the corresponding drive body so as to be height-adjustable by means of screw thread, the corresponding heddle holders are vertically locked with respect to this coupling element and this coupling element is freely rotatable with respect to the heddle holders, or the heddle holders are attached to the coupling element so as to be height-adjustable by means of screw thread, the corresponding drive body is vertically locked with respect to this coupling element and this coupling element is freely rotatable with respect to the drive body.

10. The selvedge device according to claim 9, characterized in that the coupling element is of a rod-shaped design and is either provided with at least two local diameter reductions in which a corresponding heddle holder is arranged in a vertically locked manner, so that the coupling element is freely rotatable with respect to the heddle holder and is provided with at least one local external screw thread, in which a corresponding internal screw thread of the drive body engages, or is provided in at least two locations with a local external screw thread, in which a corresponding internal screw thread of a corresponding heddle holder engages and in which the drive body is arranged in a vertically locked manner, so that the coupling element is arranged so as to be freely rotatable with respect to the drive body.

11. The selvedge device according to claim 1, characterized in that the selvedge device comprises a drive means for automatically adjusting the height of the height-adjustable heddle holders.

12. The selvedge device according to claim 1, characterized in that each heddle holder comprises a bar-shaped heddle carrier (16) on which the corresponding heddles are fittable so as to be laterally displaceable.

13. The selvedge device according to claim 1, characterized in that said drive bodies are provided with guide elements (14) and the selvedge device comprises vertically extending guides (15) for guiding the guide elements (14) during the reciprocating movements.

14. A weaving machine comprising a selvedge device, characterized in that the selvedge device is a selvedge device according to claim 1.

15. The weaving machine according to claim 14, characterized in that the weaving machine is a jacquard weaving machine, comprising a jacquard which is arranged above a fabric to be formed, in which the selvedge device is arranged between the jacquard and the fabric to be formed.

16. The weaving machine according to claim 14, characterized in that the weaving machine is a double-face weaving machine.

* * * * *